US006960106B2

(12) United States Patent
Matsuda

(10) Patent No.: US 6,960,106 B2
(45) Date of Patent: Nov. 1, 2005

(54) PERSONAL WATERCRAFT

(75) Inventor: Yoshimoto Matsuda, Kobe (JP)

(73) Assignee: Kawasaki Jukogyo kabushiki Kaisha, Kobe (JP)

( * ) Notice: Subject to any disclaimer, the term of this patent is extended or adjusted under 35 U.S.C. 154(b) by 0 days.

(21) Appl. No.: 10/744,025

(22) Filed: Dec. 22, 2003

(65) Prior Publication Data

US 2004/0152372 A1 Aug. 5, 2004

(30) Foreign Application Priority Data

Dec. 24, 2002 (JP) ..... 2002-372436

(51) Int. Cl.[7] ..... B63H 21/22
(52) U.S. Cl. ..... 440/1; 440/2
(58) Field of Search ..... 440/1, 2

(56) References Cited

U.S. PATENT DOCUMENTS 6,719,596 B2 * 4/2004 Funayose et al. ..... 440/1
2003/0109184 A1 * 6/2003 Kanno ..... 440/1

* cited by examiner

*Primary Examiner*—Jesus D. Sotelo
(74) *Attorney, Agent, or Firm*—Alleman Hall McCoy Russell & Tuttle LLP

(57) ABSTRACT

A personal watercraft comprises an engine, a sensor configured to detect an operating state of the engine, a control device configured to control an operation of the engine based on a detection signal from the sensor, and a display device including a first display portion configured to output a state of the watercraft based on data output from the control device, wherein the display device includes a storage portion configured to store the data output from the control device.

7 Claims, 7 Drawing Sheets

PERSONAL WATERCRAFT

BACKGROUND OF THE INVENTION

1. Field of the Invention

The present invention relates to a jet-propulsion personal watercraft (PWC). More particularly, the present invention relates to a display device configured to display an operating state of the personal watercraft.

2. Description of the Related Art

In recent years, jet-propulsion personal watercraft have been widely used in leisure, sport, rescue activities, and the like. The personal watercraft is equipped with an engine mounted within a space surrounded by a hull and a deck. The personal watercraft is configured to have a water jet pump that pressurizes and accelerates water sucked from a water intake generally provided on a bottom surface of the hull and ejects it rearward from an outlet port of the water jet pump. As the resulting reaction, the personal watercraft is propelled forward.

The engine is provided with a number of sensors configured to detect an operating state of the engine, such as a crank position sensor configured to detect an engine speed of the engine, and a hydraulic-pressure sensor configured to detect a pressure of oil that circulates within the engine. The personal watercraft is equipped with an electric control unit (ECU) configured to control an operation of the engine. The ECU is electrically connected to the sensors. A signal detected by each of the sensors is transmitted to the ECU, and based on the signal, the ECU feedback-controls the operation of the engine.

In some personal watercraft, the ECU is configured to store data (information) associated with a drive state of the watercraft, which are represented by detection signals from the sensors, in a non-volatile memory such as an EEPROM (electrically erasable programmable read-only memory) or a flash memory built in the ECU. For example, Published Japanese Translation of PCT International Application, No. 2002-505725 (FIG. 1, pages 6 and 7) discloses an outboard engine, i.e., an engine externally mounted on a body of a boat, which is configured to store data such as an engine speed in an ECU equipped therein.

The above described data stored in the ECU is transferred to a computer which is, as desired, connected to the ECU. The transferred data is used to check a drive history of the watercraft, for the purpose of, for example, maintenance of the watercraft.

In order to feedback-control various operations of the engine based on the obtained data, the ECU must obtain detection signals from the sensors at relatively short sampling periods and carry out calculation for obtaining control information, using the detection signals. Therefore, when the detection signals from the sensors are written to memories built in the ECU concurrently with the feedback-control of the engine based on the obtained data, a load on a processing unit contained in the ECU increases.

In the configuration disclosed in the above described publication, during the operation of the engine, the obtained data are temporarily stored in a volatile memory such as a DRAM (dynamic random access memory) or a SRAM (static random access memory), and an electric power is supplied from a battery to the ECU for a certain time after the engine stops, to allow the data stored in the volatile memory to be re-written to the non-volatile memory. In general, since the time required to write data in the volatile memory is shorter than that in the non-volatile memory, the load on the processing unit can be reduced while the engine is subjected to the feedback-control, by writing the data in the volatile memory.

However, the ECU consumes a relatively large amount of electric power because of the presence of numerous electronic components mounted therein. And, the battery equipped in the personal watercraft is charged only when the engine is operating, and is not charged any more after the engine stops. Under this condition, if the ECU is energized with the engine in a stopped state, a relatively large amount of electric power is consumed in the battery, which may make it difficult for the engine to start up next.

SUMMARY OF THE INVENTION

The present invention addresses the above described condition, and an object of the present invention is to provide a personal watercraft capable of inhibiting an increase in a load on an ECU and of inhibiting power consumption in a battery, when data associated with a state of the watercraft, which are obtained from sensors, are stored in memories.

According to the present invention, there is provided a personal watercraft comprising an engine, a sensor configured to detect an operating state of the engine, a control device configured to control an operation of the engine based on a detection signal from the sensor, and a display device including a first display portion configured to output a state of the watercraft based on data output from the control device, wherein the display device includes a storage portion configured to store the data output from the control device.

For example, the display device is configured to output data indicative of a ship speed and data indicative of an oil temperature, respectively. The display device is configured to receive the signal indicative of the state of the watercraft (ship speed or oil temperature) obtained based on the detection signal from each of the sensors, which is output from the control device such as an ECU (electric control unit) and to output the signal in order to notify a rider or an operator of the state of the watercraft. Further, the display device is provided with the storage portion having a non-volatile memory or the like and is configured to store the signal output from the control device to the display device in the storage portion.

In the personal watercraft constructed as described above, since feedback control of the engine and storage of the data associated with the state of the watercraft are carried out in different devices, a load on the control device during an operation of the engine can be reduced. Typically, the control device is built in the body of the watercraft, and the display device is provided in the instrument panel or the like, which is easily accessible from outside. Therefore, the data stored in the storage portion of the display device can be easily output.

The personal watercraft may further comprise a battery configured to supply an electric power to the control device, wherein the electric power may be supplied from the battery to the storage portion by an electric power supply circuit different from an electric power supply circuit configured to supply the electric power to the control device. The storage portion including the non-volatile memory, a writing circuit, and the like makes it possible to reduce a power consumption in contrast to the control device. Therefore, in the above configuration, by cutting off supply of the electric power to the control device and by supplying the electric power only to the storage portion when the data associated with the state of the watercraft are stored after the engine stops, the power consumed in the battery can be reduced.

The electric power may be supplied from the battery to the storage portion for a predetermined time after supply of the electric power to the control device has been cut off. In this case, all the data associated with the state of the watercraft, which are obtained from the sensors by the control device during an operation of the engine, can be stored in the storage portion. Also, by appropriately setting a time period during which the electric power is supplied to the storage portion after the engine stops, power consumption in the battery can be inhibited.

The personal watercraft may further comprise an operation portion configured to output an instruction signal that causes the data stored in the storage portion to be output, wherein the display device may include a second display portion configured to output the data, in accordance with the instruction signal from the operation portion. In this configuration, since the data indicative of the state of the watercraft can be output in the second display portion by operating the operation portion, the data can be easily obtained without connecting a computer to the control device to allow data to be transferred to the computer, or without detaching the control device from an inside of the body, unlike the conventional watercraft.

The display device may further include an audio output portion configured to output an audio. The display portion included in the instrument panel provided in the personal watercraft is typically capable of displaying only a small amount of data at a time, but by outputting the data in the form of an audio, more data can be output. In addition, the rider or the operator can check such audio while performing other works.

The sensor may include an engine speed sensor configured to detect an engine speed of the engine, the control device may be configured to output data indicative of the engine speed based on a detection signal from the engine speed sensor to the display device, and the display device may be configured to output the data indicative of the engine speed sensor in the first display portion and to store the data in the storage portion. In this configuration, data relating to the engine speed, which is useful in determining a drive history of the watercraft, can be stored and preserved.

The storage portion may be configured to store an operation time of the engine for each of predetermined engine speed ranges. The predetermined engine speed ranges include, for example, a low-speed range, a medium-speed range, and a high-speed range. The operation time for each of the predetermined speed ranges is stored in the storage portion. By doing so, a drive state of the watercraft can be stored in a simplified manner as desired and, therefore, more data can be preserved.

The storage portion may be configured to store a ratio of the operation time for the each of the predetermined engine speed ranges to a total operation time for the predetermined engine speed ranges. Also in this case, the drive state of the watercraft can be stored in a simplified manner, and more data can be stored. Assuming that the data indicative of the above ratio is displayed on the instrument panel and a total operation time of the engine is 200 h which is divided into 40 h for the low-speed range (20%), 60 h for the medium-speed range (30%), and 100 h for the high-speed range (50%), display may be performed as: "T_200, L_20, M_30, and H_50."

The above and further objects and features of the invention will more fully be apparent from the following detailed description with accompanying drawings.

DETAILED DESCRIPTION OF THE PREFERRED EMBODIMENTS

Figure 1:
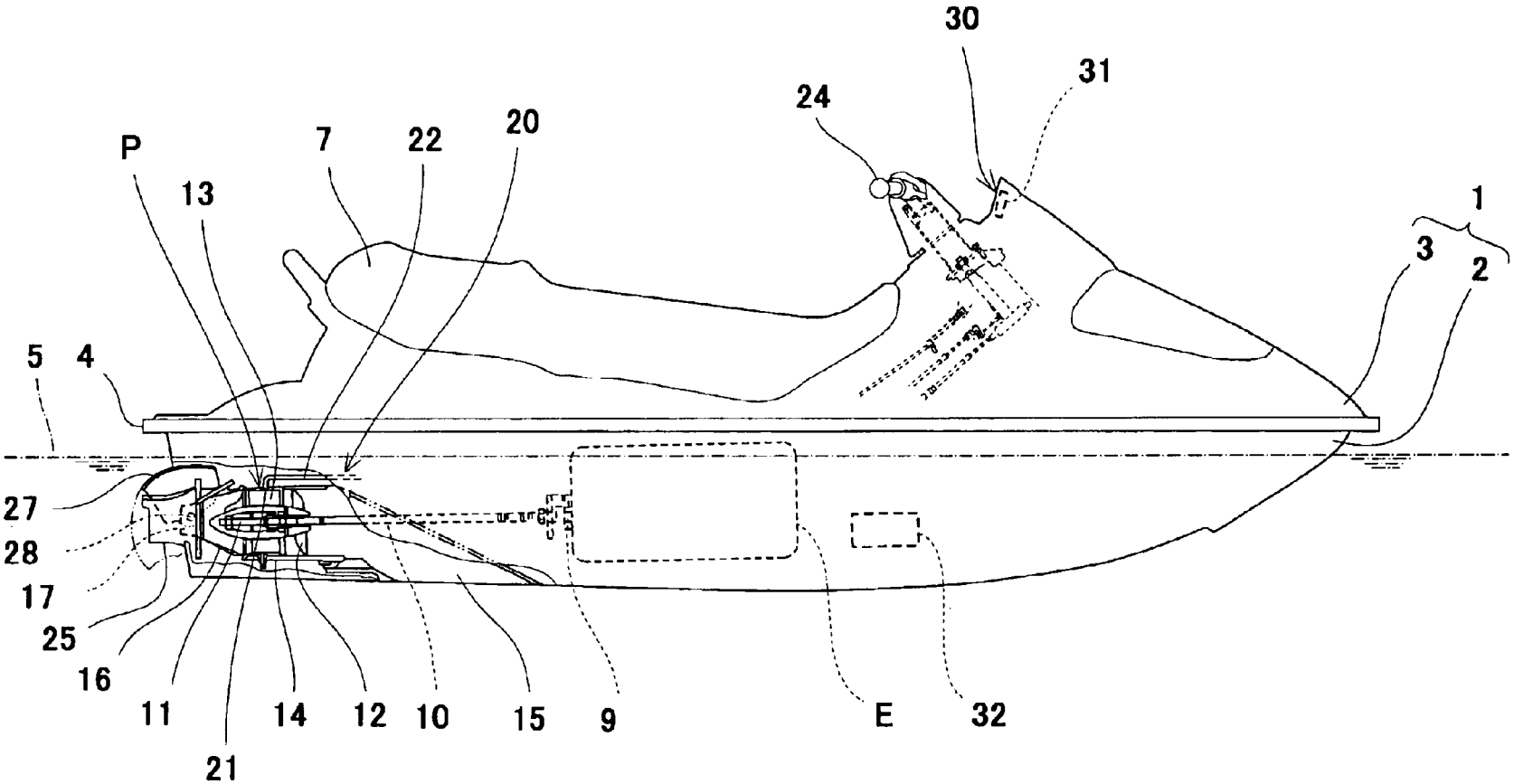
FIG. 1 is a side view of a personal watercraft according to an embodiment of the present invention.

Hereinafter, an embodiment of a personal watercraft of the present invention will be described with reference to the accompanying drawings. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft while the body 1 is at rest on the water.

Figure 2:
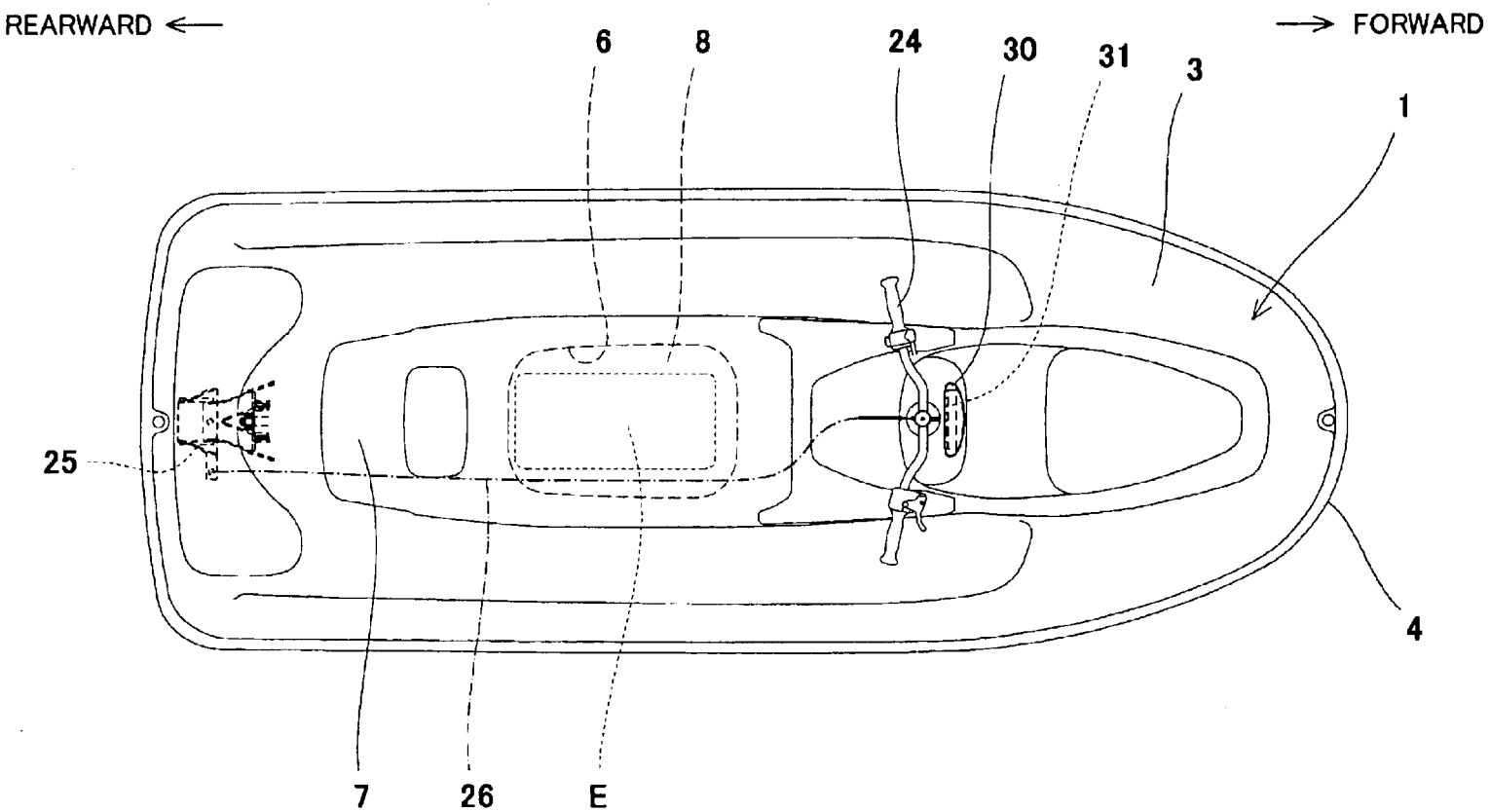
FIG. 2 is a plan view of the personal watercraft in FIG. 1.

As shown in FIG. 2, an opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the opening 7.

An engine room 8 is provided in a space defined by the hull 2 and the deck 3 below the opening 6. An engine E is mounted within the engine room 8 and configured to drive the watercraft. The engine room 8 has a convex-shaped transverse cross-section and is configured such that its upper portion is smaller than its lower portion. In this embodiment, the engine E is an in-line four-cylinder four-cycle engine.

As shown in FIG. 1, the engine E is mounted such that a crankshaft 9 extends along the longitudinal direction of the body 1. An output end of the crankshaft 9 is rotatably coupled integrally with a pump shaft 11 of a water jet pump P provided on the rear side of the body 1 through a propeller shaft 10. An impeller 12 is attached on the pump shaft 11 of the water jet pump P. Fairing vanes 13 are provided behind the impeller 12. The impeller 12 is covered with a pump casing 14 on the outer periphery thereof.

A water intake 15 is provided on the bottom of the body 1. The water intake 15 is connected to the pump casing 14 through a water passage. The pump casing 14 is connected to a pump nozzle 16 provided on the rear side of the body 1. The pump nozzle 16 has a cross-sectional area that gradually reduces rearward, and an outlet port 17 is provided on the rear end of the pump nozzle 16.

Water outside the watercraft is sucked from the water intake 15 and fed to the water jet pump P. The water jet pump P pressurizes and accelerates the water, and the fairing vanes 13 guide water flow behind the impeller 12. The water is ejected through the pump nozzle 16 and from the outlet port 17 and, as the resulting reaction, the watercraft obtains a propulsion force.

The personal watercraft according to this embodiment comprises an open-looped cooling system 20. As shown in FIG. 1, the cooling system 20 is provided with a water-drawing port 21 provided on the pump casing 14 of the water jet pump P. And, the cooling system 20 is configured to draw some of the water pressurized by the water jet pump P through the water-drawing port 21 for use as cooling water to cool components of the engine E and supply the cooling water to the engine E through a cooling water pipe 22. The cooling water cools the components of the engine E.

A bar-type steering handle 24 is provided on the deck 3 to be located in front of the seat 7. The handle 24 is connected to a steering nozzle 25 provided behind the pump nozzle 16 through a cable 26 in FIG. 2. When the rider rotates the handle 24 clockwise or counterclockwise, the steering nozzle 25 is swung toward the opposite direction so that the ejection direction of the water being ejected through the pump nozzle 16 can be changed, and the watercraft can be correspondingly turned to any desired direction while the water jet pump P is generating the propulsion force.

As shown in FIG. 1, a bowl-shaped reverse deflector 27 is provided on the rear side of the body 1 and on an upper portion of the steering nozzle 25 such that it can vertically swing around a horizontally mounted swinging shaft 28. When the deflector 27 is swung downward to a lower position around the swinging shaft 28 so as to be located behind the steering nozzle 25, the water being ejected rearward from the steering nozzle 25 is ejected substantially foward. As the resulting reaction, the personal watercraft moves rearward.

As shown in FIGS. 1 and 2, and instrument panel 30 is provided in front of the handle 24 on the deck 3 so that the rider straddling the seat 7 can easily visually check the instrument panel 30. A display device 31 is built in the instrument panael 30. The display device 31 is configured to receive data from an ECU (electric control unit) 32 described later and to display various data such as a travel speed, a travel distance, and the amount of remainiong fuel on the instrument panel 30 using a liquid crystal display.

As shown in FIG. 1, the ECU 32 is equipped within the body 1 to control an operation of the engine E, and is electrically connected to a number of sensors attached within the body 1. Based on detection signals from the sensors, the ECU 32 feedback-controls the engine E.

Figure 3:
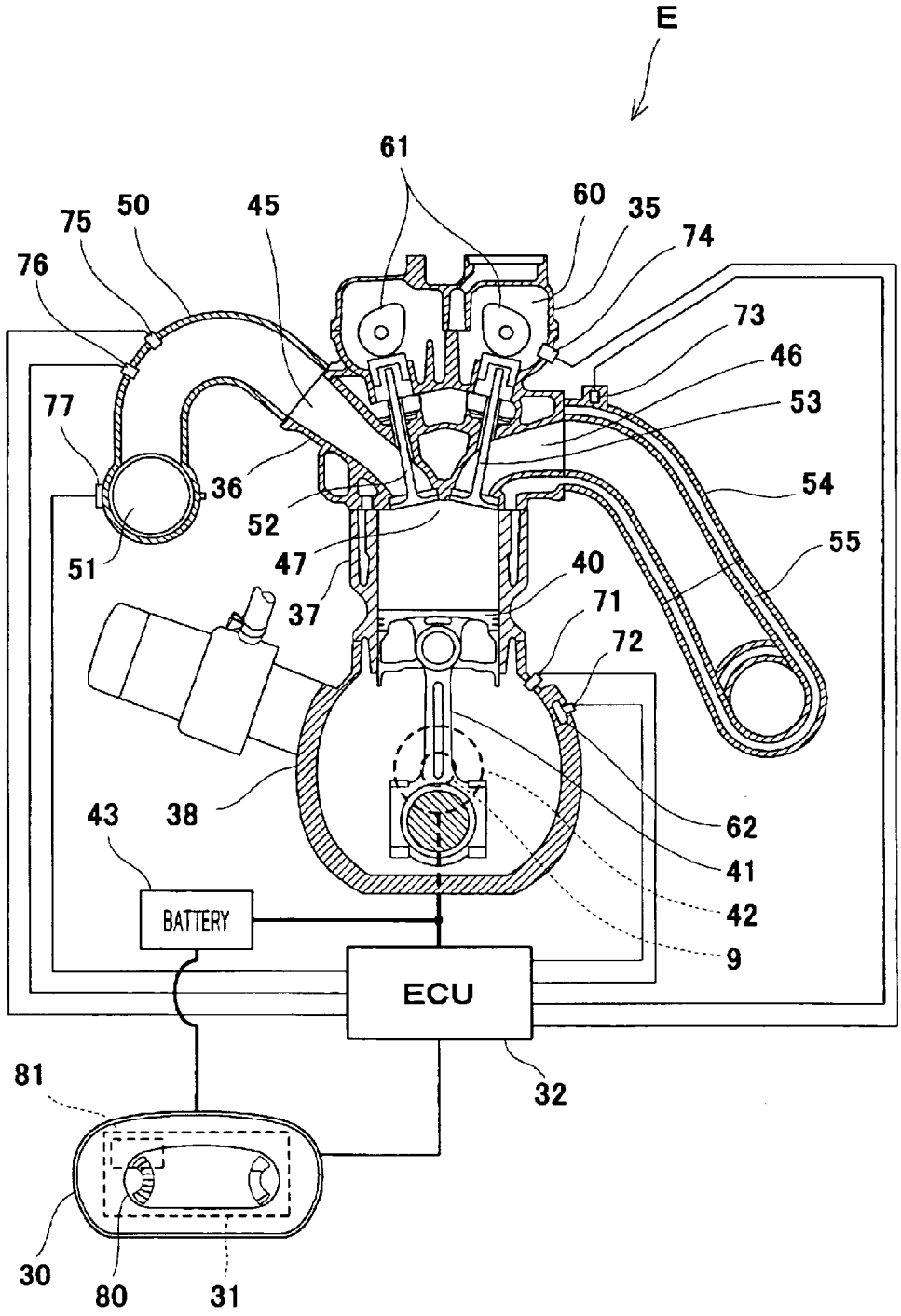
FIG. 3 is a schematic view showing a configuration in which various sensors, an ECU, and a display device are connected to one another in the personal watercraft in FIG. 1.

As shown in FIG. 3, the engine E is mainly comprised of a cylinder head 36 covered with a cylinder head cover 35 from above, a cylinder block 37 connected to a lower portion of the cylinder head 36, and a crankcase 38 connected to the lower portion of the cylinder block 37.

Pistons 40 are each provided within the cylinder block 37. The pistons 40 are each connected to the crankshaft 9 through a connecting rod 41. The pistons 40 are configured to vertically reciprocate within the cylinder block 37 in cooperation with the rotation of the crankshaft 9. The engine E is provided with a generator 42. When the crankshaft 9 rotates, the generator 42 generates an electric power, which is stored in a battery 43 connected to the generator 42.

Air-intake ports 45 and exhaust ports 46 are provided within the cylinder head 36. Air taken in from outside flows through the air-intake ports 45 and an exhaust gas flows through the exhaust ports 46. Hereinbelow, "upstream" and "downstream" are defined from the perspective of a flow passage of the taken-in air or the exhaust gas. An upstream end portion of each of the air-intake ports 45 opens into a side portion of the engine E in the cylinder head 36, and a downstream end portion thereof opens inside a combustion chamber 47 formed by the cylinder head 36, the cylinder block 37, and the piston 40. Meanwhile, a downstream end portion of each of the exhaust ports 46 opens into the other side portion or the engine E in the cylinder head 36, and an upstream end portion thereof opens inside the combustion chamber 47.

Air-intake pipes 50 are each connected to the upstream end portion of a corresponding one of the air-intake ports 45 and throttle valves 51 are each provided at a location of a corresponding one of the air-intake pipes 50 to control a flow rate of the taken-in air. And, air-intake valves 52 are each provided in the downstream end portion of a corresponding one of the air-intake ports 45 to control a flow of the taken-in air to the combustion chamber 47. Meanwhile, exhaust valves 53 are each provided in the upstream end portion of the exhaust port 46 to control a flow of the exhaust gas from the combustion chamber 47. And, exhaust pipes 54 are each connected to the downstream end portion of a corresponding one of the exhaust ports 46 and communicates with the outside of the body 1 through a muffler or the like. The exhaust pipe 54 has a double-walled structure provided with a water jacket 55 within which the cooling water flows so as to surround and thereby cool the exhaust gas flowing within the exhaust pipe 54.

A cam space 60 is provided between the cylinder head cover 35 and the cylinder head 36. Within the cam space 60, cams 61 for air-intake and for exhaust are provided. The cams 61 are configured to rotate in cooperation with the crankshaft 9 in a cycle half as long as that of the crankshaft 9. This allows the air-intake valve 52 and the exhaust valve 53 to open and close openings of end portions of the air-intake ports 45 and the exhaust ports 46 on the combustion chamber 7 side at predetermined timings, thereby controlling both the flow of the taken-in air and the flow of the exhaust gas.

Various sensors are attached to the engine E and auxiliary equipment such as the air-intake pipe 50 and the exhaust pipe 54. Specifically, as shown in FIG. 3, a crank position sensor (hereinafter referred to as "CPS") 71 is provided on a wall portion of the crankcase 38. The CPS 71 is configured to detect a rotational angle of the engine E. An oil gallery 62 is formed within the wall portion of the crankcase 38 and configured to form an oil passage of the oil that circulates within the engine E. A hydraulic-pressure sensor 72 is provided in the oil gallery 62 and configured to detect a pressure of the oil flowing within the oil gallery 62.

A wall-temperature sensor 73 is provided in an outer wall portion of the exhaust pipe 54 and configured to detect a wall temperature of the exhaust pipe 54. A cam-angle sensor 74 is provided on the cylinder head 36 and configured to detect a rotational angle of the cam 61. An air-temperature sensor 75 and a boost sensor 76 are provided on a wall portion of the air-intake pipe 50 and configured to detect a temperature of the taken-in air and to detect a boost pressure, respectively. Further, a throttle position sensor (hereinafter referred to as "TPS") 77 is provided in the vicinity of the throttle valve 51 and configured to detect an open position of the throttle valve 51.

The above described sensors 71 to 77 are electrically connected to the ECU 32 equipped in the personal watercraft, and are configured to send detected signals to the ECU 32. Based on the received signals from the sensors 71 to 77, the ECU 32 obtains data (information) indicative of an operating state of the engine E. And, based on the obtained data, the ECU 32 controls the operation of the engine E, such as adjustment of the amount of fuel to be injected from a fuel injector (not shown), and adjustment of ignition timing of an ignition plug (not shown).

The ECU 32 is connected to the battery 43 through an electric wire. The ECU 32 is electrically connected to the display device 31 built in the instrument panel 30 through a signal line.

Figure 4:
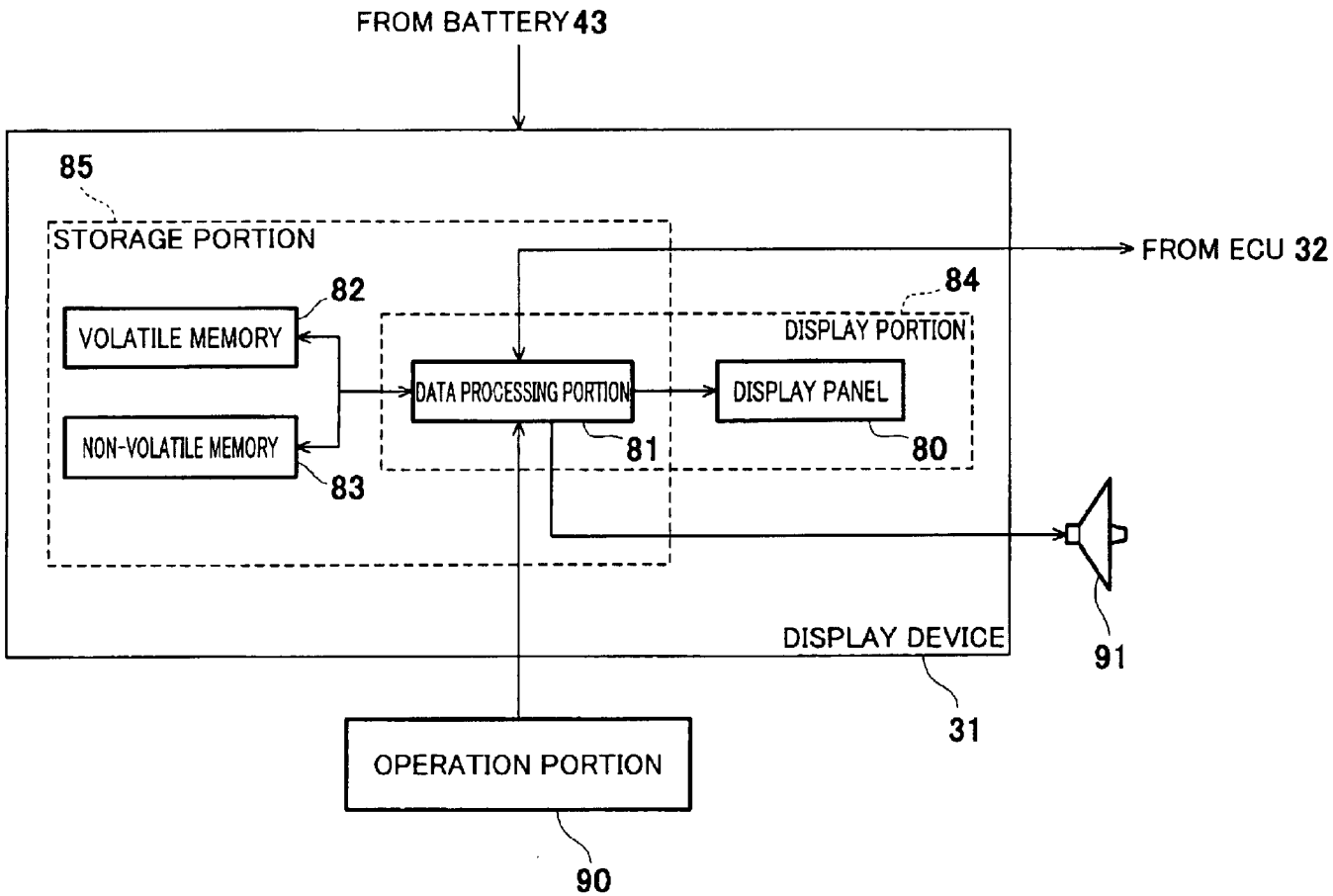
FIG. 4 is a schematic block diagram showing a configuration of the display device in FIG. 3.

As shown in a block diagram in FIG. 4, the display device 31 includes a display panel 80 configured to have a liquid crystal display capable of displaying data and a data processing portion 81 configured to process various data. The display device 31 further includes a volatile memory 82 and a non-volatile memory 83 for data storage. The display device 31 is directly connected to the battery 43 through an electric wire with an electric circuit provided thereon. This electric circuit is different from an electric circuit connecting the battery 43 to the ECU 32. The electric power is supplied from the battery 43 to the display device 31 independently of the ECU 32.

The data processing portion 81 is electrically connected to the ECU 32 through the signal line and configured to receive a signal from the ECU 32. The data processing portion 81 contains a ROM (not shown). The data processing portion 81 is configured to read out various programs from the ROM and carry out various data processing with reference to the signals (data) output from the ECU 32. Also, the data processing portion 81 is configured to cut off the electric power supplied from the battery 43 after a lapse of a predetermined time after the engine E has stopped, thereby causing the display device 31 to stop.

The display panel 80 is electrically connected to the data processing portion 81 through a signal line. The data processing portion 81 is configured to output data based on the signal output from the ECU 32, which is to be displayed on the display panel 80, to the display panel 80. The display panel 80 is configured to display the data based on an input from the data processing portion 81. While a display portion 84 included in the display device 31 is comprised of the display panel 80 and the data processing portion 81, the display portion 84 is configured to display data from a storage portion 85 built in the display device 31 by an operation performed by the rider or an operator for maintenance, as well as display the data based on the signal output from the ECU 32 as described above.

The volatile memory 82 and the non-volatile memory 83 are electrically connected to the data processing portion 81. The data processing portion 81 is configured to temporarily store the data obtained based on the signal output from the ECU 32 in the volatile memory 82 capable of high-speed writing. And, the data temporarily stored in the volatile memory 82 is re-written to the non-volatile memory 83 at times, for example, when a load on the data processing portion 81 is small, and stored therein permanently. The data processing portion 81, the volatile memory 82 and the non-volatile memory 83 constitute the storage portion 85 configured to store the data obtained from the signals (data) output from the ECU 32.

An operation portion 90 and an audio output portion 91 are provided on the instrument panel 30 (FIG. 3). As shown in FIG. 4, the operation portion 90 and the audio output portion 91 are each electrically connected to the data processing portion 81. The rider or an operator for maintenance enters a predetermined instruction signal to the data processing portion 81 by operating the operation portion 90. By operating the operation portion 90, the data stored in the non-volatile memory 83 is displayed on the display portion 84. The audio output portion 91 is configured to output various data in the form of audio (e.g., sound or language) based on the signal output from the data processing portion 81.

As described above, the display portion 84 is configured to display the data stored in the non-volatile memory 83 as well as the data based on the data output from the ECU 32. More specifically, the display portion 84 is capable of switching the data to be displayed, between the data output from the ECU 32 and the data stored in the non-volatile memory 83, by operating the operation portion 90. Alternatively, the display portion 84 may be provided with a first display portion configured to display the data based on the data output from the ECU 32 and a second display portion configured to display the data stored in the non-volatile memory 83.

Figure 5:
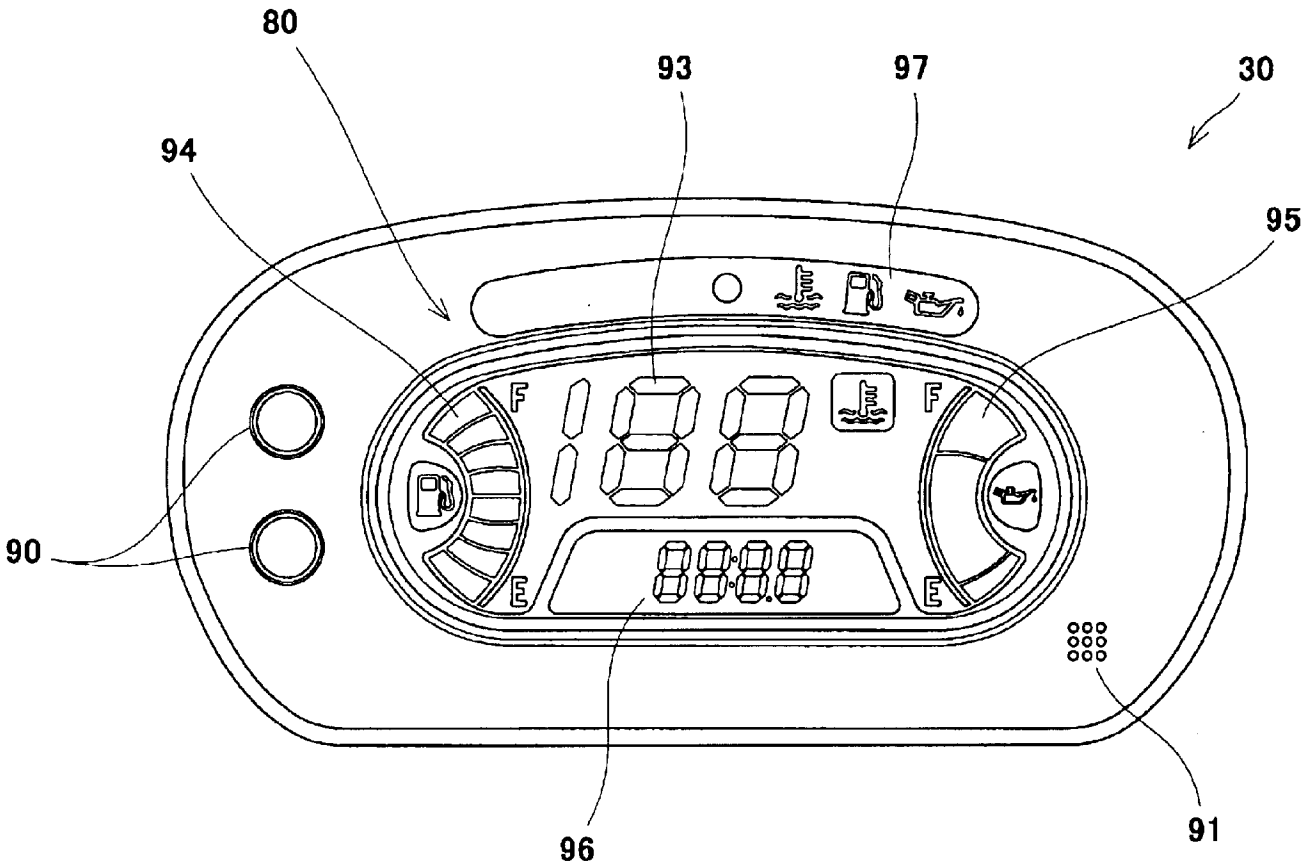
FIG. 5 is a view showing an external appearance of an instrument panel in FIG. 3.

As shown in FIG. 5, on the instrument panel 30, the display panel 80, the operation portion 90 of a button-switch type, and the audio output portion 91 having a speaker, are provided. And, on the display panel 80, a speed display portion 93 configured to display a travel speed of the watercraft, a fuel display portion 94 configured to display the amount of remaining fuel, and an oil display portion 95 configured to display the amount of remaining oil, are provided. In addition, on the display panel 80, a multi-display portion 96 is provided and configured to display various data such as the time, the travel distance, and the engine speed of the engine E by operating the operation portion 90 to switch the data to be displayed thereon. Further, on the display panel 80, a warning display portion 97 is provided and configured to notify the rider of overheating of the engine E, a decrease in the fuel or the oil, etc.

A flow of an operation for storing the data associated with the operating state of the personal watercraft constructed as described above will be described with reference to the flowcharts in FIGS. 6 and 7.

Figure 6:
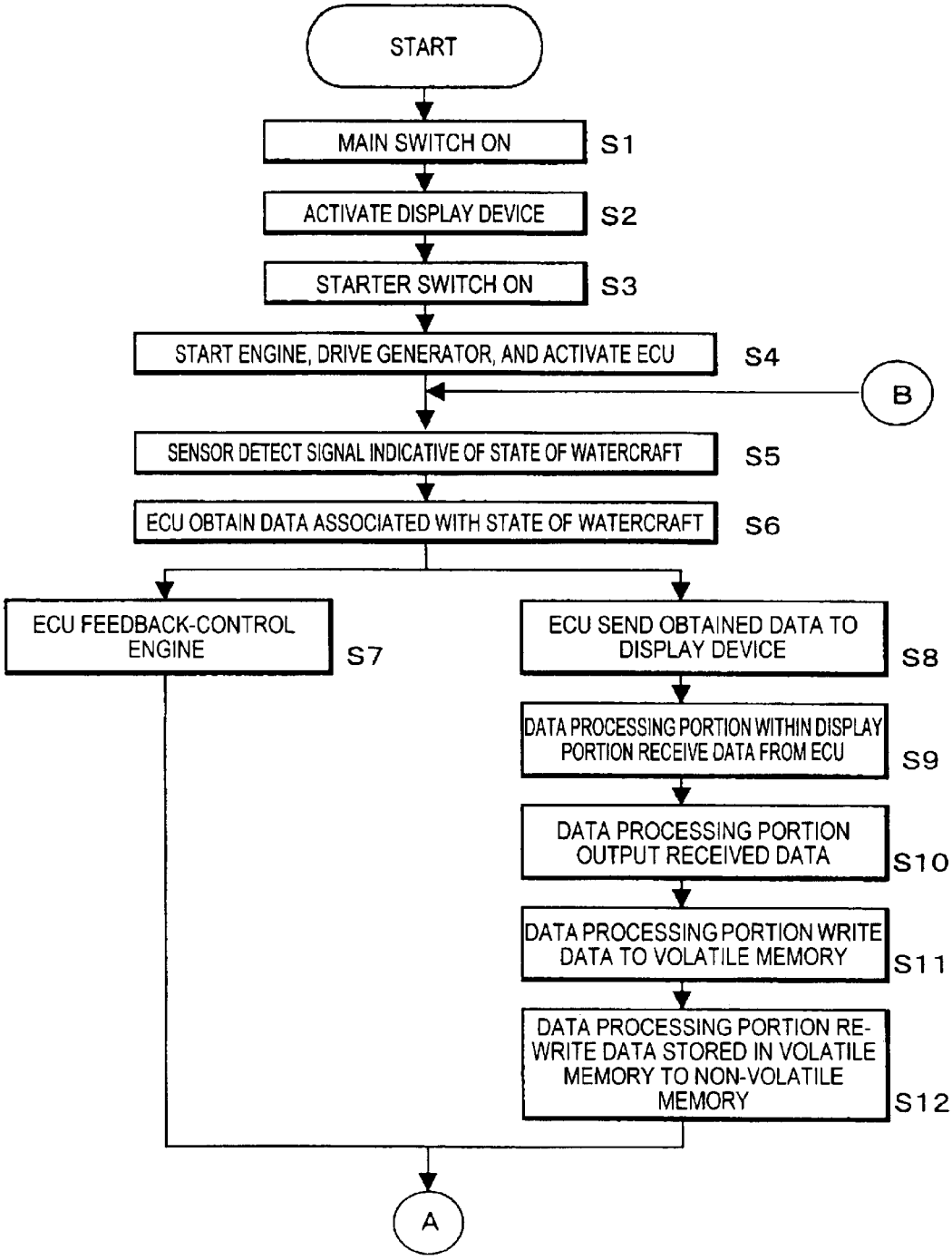
FIG. 6 is a flowchart showing a procedure of an operation for storing data associated with a state of the personal watercraft in FIG. 1.

As shown in FIG. 6, upon a main switch (not shown) provided in the vicinity of the handle 24 (FIG. 1) being turned ON (S1), an electric power is supplied from the battery 43 (FIG. 3) to the display device 31 within the instrument panel 30, thereby causing the display device 31 to be activated (S2). Then, upon a starter switch (not shown) being turned ON (S3), the engine E starts up and the generator 42 is driven, while the electric power is supplied from the battery 43 to the ECU 32, which is thereby activated (S4). In a personal watercraft which is not equipped with a main switch, when a starter switch is turned ON, the instrument panel 30 is activated. Simultaneously, the engine E starts up and the ECU 32 is activated.

When the ECU 32 is activated, the sensors 71 to 77 (FIG. 3) attached in the engine E and the auxiliary equipment detect signals indicative of the state of the watercraft (S5). And, the signals detected by the sensors 71 to 77 are sent to the ECU 32, which obtains various data associated with the state of the watercraft based on these detection signals (S6). In this case, the ECU 32 obtains data such as the engine speed of the engine E, the wall temperature, the hydraulic pressure, the rotational angle of the cam 37, the air-intake temperature, the boost pressure, and data relating to the travel speed and the travel distance derived from former information. The ECU 32 feedback-controls the engine E based on the above obtained data (S7). The ECU 32 sends these data to the display device 31 (S8), and the data processing portion 81 receives the data (S9).

The data processing portion 81 outputs part or all of the received data using the display panel 80 and the audio output portion 91 (S10). The data output in step 10 relates to the travel speed, the amount of remaining fuel, and the amount of remaining oil, which are associated with the watercraft traveling now. In addition to this, data such as the time, the travel distance, and the engine speed can be displayed on the multi-display portion 96, by operating the operation portion 90.

Concurrently with the operation in step 10, the data processing portion 81 writes the received data from the ECU 32 to the volatile memory 82 (S11). And, the data processing portion 81 re-writes the data stored in the volatile memory 82 to the non-volatile memory 83 at certain times, for example, when the load on the data processing portion 81 is relatively small (S12). In this manner, the various data associated with the state of the watercraft obtained in the ECU 32 are stored in the non-volatile memory 83 within the storage portion 85 built in the instrument panel 30. The operations of the data processing portion 81 in Steps 11 and 12 are carried out independently of the ECU 32 based on a predetermined program contained in the data processing portion 81.

The data stored in the storage portion 85 may be data obtained directly from the ECU 32, or may be somewhat simplified to allow data associated with the state of the watercraft for a long time period to be stored. For example, the engine speed of the engine E may be divided into a plurality of engine speed ranges such as a high-speed range, a medium-speed range, and a low-speed range, and data indicative of operation times of the engine E corresponding to these speed ranges may be stored in the storage portion 85. The operations in the above steps 5 to 12 are repeated during the operation of the engine E.

Figure 7:
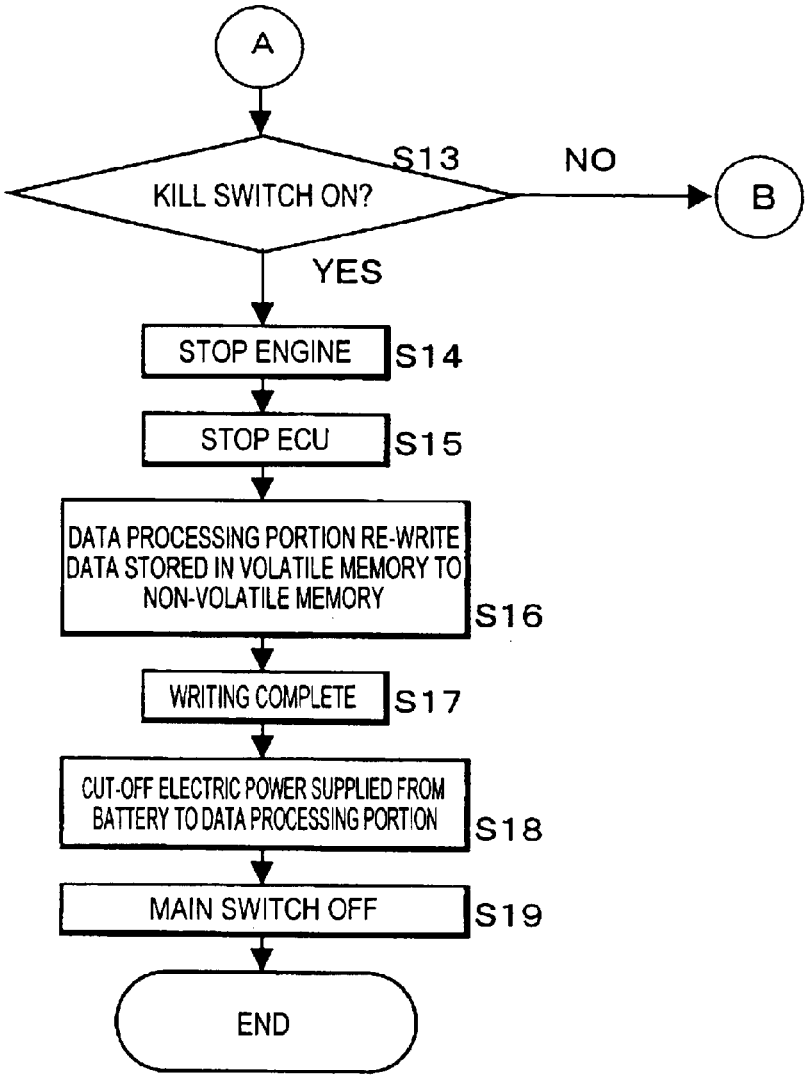
FIG. 7 is a flowchart showing a procedure following the procedure in FIG. 6.

Subsequently, as shown in FIG. 7, upon a kill switch (not shown) configured to stop the engine E being turned ON (S13), the engine E stops (S14), and the ECU 32 stops (S15), so that supply of the electric power from the battery 43 to the ECU 32 is cut off. Until a predetermined time lapses after supply of the electric power to the ECU 32 has been cut off, the electric power continues to be supplied from the battery 43 to the data processing portion 81 by the electric circuit different from the electric circuit configured to supply the electric power to the ECU 32. And, during this time, the data processing portion 81 re-writes the data within the volatile memory 82 to the non-volatile memory 83 (S16). When completing re-writing the data to the non-volatile memory 83, (S17), the data processing portion 81 cuts off the electric power supplied from the battery 43 (S18). Thereafter, the main switch of the watercraft is turned OFF (S19). While the electric power is supplied from the battery 43 as a main power source to the data processing portion 81, supply of the electric power from the battery 43 may be cut off as soon as the kill switch is turned OFF and the electric power may be supplied from another auxiliary power source for a certain time.

The data processing portion 81 judges whether or not supply of the electric power to the ECU 32 has been cut off, based on whether or not the signal is output from the ECU 32 to the data processing portion 81. After the engine E stops, a minimum amount of electric power may be supplied from the battery 43 to the ECU 32 in view of a function of the ECU 32. When the data processing portion 81 can write the data to the non-volatile memory 83 at a high speed and can write the data indicative of the state of the watercraft which is output from the ECU 32 within a relatively short time after obtaining such data from the ECU 32, the volatile memory 82 may be omitted.

In accordance with the personal watercraft constructed as described above, since the data indicative of the state of the watercraft is stored in the storage portion 85 within the display device 31, which is separate from the ECU 32, the load on the ECU 32 during the operation of the engine E can be reduced. In addition, after the engine E stops, the electric power is not supplied from the battery 43 to the ECU 32 any more, but, rather, is supplied from the battery 43 to the storage portion 85 for a short time. As a result, the power consumed from the battery 43 after the engine stops can be reduced.

The data stored in the storage portion 85 can be output in the display panel 80, the audio output portion 91 and the like, by operating the operation portion 90. For example, by pressing the operation portion 90 of the button switch type, data to be referred to are sequentially displayed according to the number of times the operation portion 90 is pressed, and one of these data is selected and displayed on the display panel 80. When a number of data are intended to be displayed, those data may be scrolled on the multi-display portion 96 within the display panel 80.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

an engine;

a sensor configured to detect an operating state of the engine;

a control device configured to control an operation of the engine based on a detection signal from the sensor;

a display device including a first portion configured to output a state of the watercraft based on data output from the control device, wherein the display device includes a storage portion configured to store the data output from the control device; and a battery configured to supply an electric power to the control device;

wherein the electric power is supplied from the battery to the storage portion by an electric power supply circuit different from an electric power supply circuit configured to supply the electric power to the control device.

2. The personal watercraft according to claim 1, wherein the electric power is supplied from the battery to the storage portion for a predetermined time after supply of the electric power to the control device is cut off.

3. A personal watercraft comprising:

an engine;

a sensor configured to detect an operating state of the engine;

a control device configured to control an operation of the engine based on a detection signal from the sensor;

a display device including a first display portion configured to output a state of the watercraft based on data output from the control device, wherein the display device includes a storage portion configured to store the data output from the control device; and an operation portion configured to output an instruction signal that causes the data stored in the storage portion to be output;

wherein the display device includes a second display portion configured to output the data, in accordance with the instruction signal from the operation portion.

4. The personal watercraft according to claim 3, wherein the display device further includes an audio output portion configured to output an audio.

5. A personal watercraft comprising:

an engine;

a sensor configured to detect an operating state of the engine;

a control device configured to control an operation of the engine based on a detection signal from the sensor; and a display device including a first display portion configured to output a state of the watercraft based on data output from the control device, wherein the display device includes a storage portion configured to store the data output from the control device;

wherein the sensor includes an engine speed sensor configured to detect an engine speed of the engine;

wherein the control device is configured to output data indicative of the engine speed based on a detection signal from the engine speed sensor to the display device; and wherein the display device is configured to display the data indicative of the engine speed sensor in the first display portion and to store the data in the storage portion.

6. The personal watercraft according to claim 5, the storage portion is configured to store an operation time of the engine for each of predetermined engine speed ranges.

7. The personal watercraft according to claim 6, wherein the storage portion is configured to store a ratio of the operation time for the each of the predetermined engine speed ranges to a total operation time for the predetermined engine speed ranges.

* * * * *